US008152984B2

(12) United States Patent
Ito

(10) Patent No.: US 8,152,984 B2
(45) Date of Patent: Apr. 10, 2012

(54) METHOD OF MANUFACTURING NOZZLE PLATE

(75) Inventor: Seiko Ito, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 861 days.

(21) Appl. No.: 12/137,889

(22) Filed: Jun. 12, 2008

(65) Prior Publication Data

US 2008/0309716 A1 Dec. 18, 2008

(30) Foreign Application Priority Data

Jun. 12, 2007 (JP) ..... 2007-155021

(51) Int. Cl.
*C25D 5/02* (2006.01)

(52) U.S. Cl. ..... 205/118; 205/122

(58) Field of Classification Search ..... 205/118, 205/122

See application file for complete search history.

(56) References Cited

U.S. PATENT DOCUMENTS

| | | | | |
|---|---|---|---|---|
| 7,326,524 | B2 | 2/2008 | Kitahara et al. | |
| 2005/0035999 | A1 * | 2/2005 | Kitahara et al. | 347/47 |

FOREIGN PATENT DOCUMENTS

| | | | |
|---|---|---|---|
| JP | H01-280566 | A | 11/1989 |
| JP | 05155017 | A * | 6/1993 |
| JP | H05-155017 | A | 6/1993 |
| JP | H07-314694 | A | 12/1995 |
| JP | H08-00808 | U | 5/1996 |
| JP | 2005-088576 | A | 4/2005 |
| JP | 2006-289863 | A | 10/2006 |
| JP | 2006-341506 | A | 12/2006 |

OTHER PUBLICATIONS

Japan Patent Office; Notice of Reasons for Rejection in Japanese Patent Application No. 2007-155021 (counterpart to the above-captioned U.S. patent application) mailed Apr. 21, 2009.

* cited by examiner

*Primary Examiner* — Luan Van
(74) *Attorney, Agent, or Firm* — Baker Botts L.L.P.

(57) ABSTRACT

A method of manufacturing a nozzle plate has steps of: (e) covering a surface of a plate with a light-curable resin; (f) covering the resin with a light-shielding member having an annular light-shielding region which encloses an opening of a nozzle hole therein in a plan view; (g) curing a portion of the resin not overlapping the light-shielding region by applying light after the step of (f); (h) exposing the resin by removing the light-shielding member after the step of (g); (i) eliminating an uncured portion of the resin after the step of (h); (j) forming a water-repellent coat on surfaces of the plate using the cured resins as masks, after the steps of (d) and (i); and (k) eliminating the cured resins after the step of (j).

4 Claims, 4 Drawing Sheets

METHOD OF MANUFACTURING NOZZLE PLATE

CROSS REFERENCE TO RELATED APPLICATION

The present application claims priority from Japanese Patent Application No. 2007-155021, which was filed on Jun. 12, 2007, the disclosure of which is herein incorporated by reference in its entirety.

BACKGROUND OF THE INVENTION

1. Field of the Invention

The present invention relates to a method of manufacturing a nozzle plate used for a liquid ejection head such as an ink-jet head.

2. Description of Related Art

An ink-jet head has a passage unit which includes a nozzle plate and other plates laminated with one another and bonded to one another with an adhesive. Within the passage unit, an ink passage is formed. Ink is supplied to the ink passage within the passage unit, and then ejected from a plurality of nozzle holes to a recording medium. The nozzle holes are formed in the nozzle plate. Here, in laminating the plates, the adhesive may sometimes enter the nozzle holes. If an amount of adhesive entering one nozzle hole differs from an amount of adhesive entering another nozzle hole, the nozzle holes may demonstrate different ejection accuracies. Therefore, various proposals have been made for preventing an adhesive from entering the nozzle holes.

Japanese Unexamined Patent Publication No. 5-155017 shows, in FIG. 1 thereof, a manufacturing method in which a photosensitive adhesive is applied to portions on a nozzle plate near nozzle holes. Then, ultraviolet-ray irradiation is performed using a masking jig which has such a printing pattern that only the photosensitive adhesive is illuminated with ultraviolet rays, to thereby cure the photosensitive adhesive. Then, the masking jig is removed, and the photosensitive adhesive left uncured is washed away. The cured photosensitive resin prevents intrusion of an adhesive into the nozzle holes.

Japanese Unexamined Utility Model Publication No. 8-808 shows, in FIG. 1 thereof, a manufacturing method in which portions on a nozzle plate near nozzle holes are coated with a silicone resin to thereby form a water-repellent adhesive region. The water-repellent adhesive region prevents intrusion of an adhesive into the nozzle holes.

SUMMARY OF THE INVENTION

According to the manufacturing method shown in the former document, a step of applying the photosensitive adhesive, a step of irradiating ultraviolet rays, and a step of washing the uncured photosensitive adhesive away are needed. According to the manufacturing method shown in the latter document, a step of coating with the silicone resin is needed. Therefore, any of the above-mentioned methods makes a manufacturing process complicated.

An object of the present invention is to provide a method of manufacturing a nozzle plate capable of preventing intrusion of an adhesive into nozzle holes and providing a simple manufacturing process.

According to an aspect of the present invention, there is provided a method of manufacturing a nozzle plate having a nozzle hole which ejects liquid. The method comprises: (a) forming the nozzle hole penetrating through an opaque plate which becomes the nozzle plate, in a thickness direction of the plate; (b) covering, with a first light-curable resin, a first surface of the plate which surface has one opening of the nozzle hole to become an ejection opening, and supplying the first light-curable resin into an area inside the nozzle hole contiguous to the one opening; (c) forming a cured resin portion from the first light-curable resin by applying, to the plate, light directed from a second surface of the plate having the other opening of the nozzle hole to the first surface of the same so as to cure a part of the first light-curable resin inside the nozzle hole and another part of the light-curable resin outside the nozzle hole, the another part overlapping the one opening in a direction from the second surface to the first surface; (d) eliminating an uncured portion of the first light-curable resin after the step of (c); (e) covering the second surface of the plate with a second light-curable resin after the step of (d); (f) covering the second light-curable resin with a light-shielding member having an annular light-shielding region which encloses the other opening therein in a plan view; (g) curing a portion of the second light-curable resin not overlapping the light-shielding region by applying, to the second light-curable resin through the light-shielding member, light directed from the second surface to the first surface, after the step of (f); (h) exposing the second light-curable resin by removing the light-shielding member after the step of (g); (i) eliminating an uncured portion of the second light-curable resin after the step of (h); (j) forming a water-repellent coat respectively on the first and second surfaces using the cured first and second light-curable resins as masks, after the steps of (d) and (i); and (k) eliminating the cured first and second light-curable resins after the step of (j).

In the above aspect, an annular protrusion made of the water-repellent coat is formed on the second surface of the nozzle plate to which another plate will be bonded, in such a manner that the annular protrusion encloses therein the other opening of the nozzle hole. The annular protrusion can effectively prevent an adhesive from entering the nozzle hole at the time when another plate is being bonded to the nozzle plate. In addition, since the annular protrusion on the second surface is formed simultaneously with the water-repellent coat on the first surface, a manufacturing process can be simplified.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a preferred embodiment of the present invention will be described with reference to the accompanying drawings. The following embodiment deals with an application of the present invention to a nozzle plate positioned to an ink-jet head.

Figure 1:
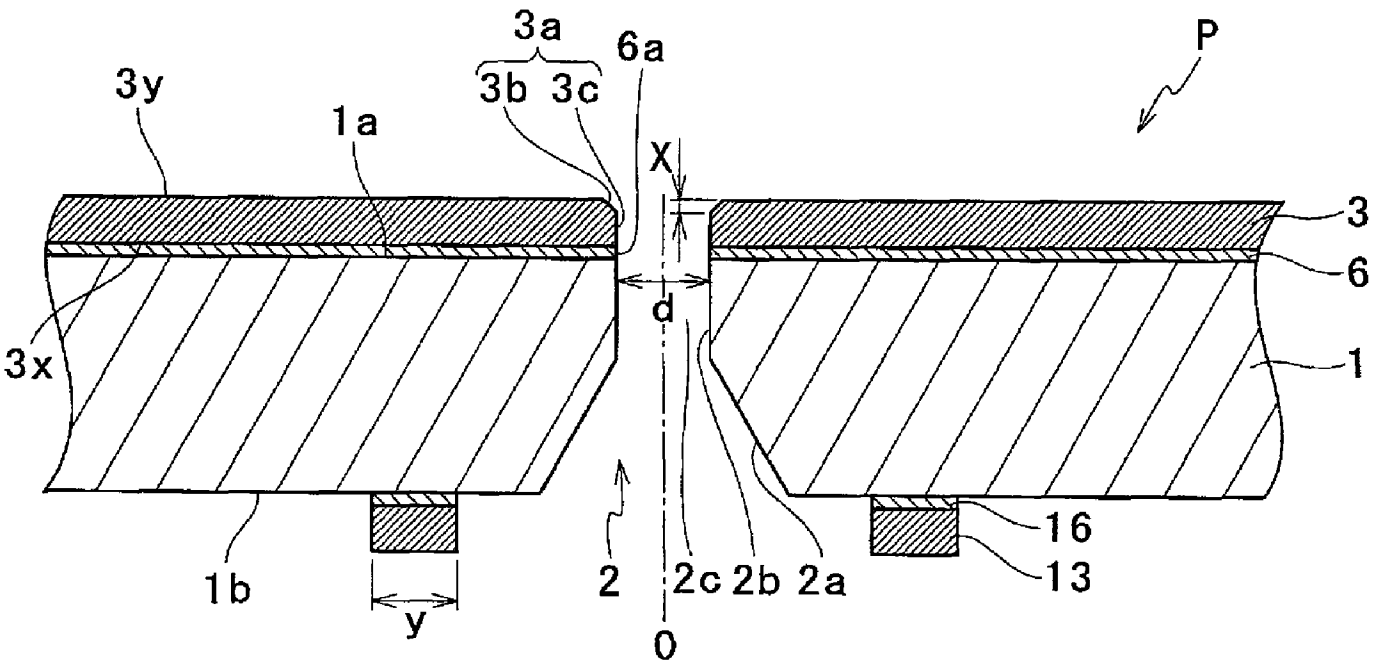
FIG. 1 is a cross sectional view of a nozzle plate according to an embodiment of the present invention.

First, the structure of a nozzle plate P according to the present embodiment will be described with reference to FIG. 1. The nozzle plate P has a substrate 1 made of stainless steel having a thickness of substantially 70 μm. The substrate 1 has a nozzle hole 2 which ejects ink formed through in a thickness direction.

The nozzle hole 2 is symmetrical to a central axis O, and includes a column portion 2*b* and a truncated cone portion 2*a*. The column portion 2*b* has a cylindrical circumference and opens towards the ejection face 1*a* of the substrate 1. The truncated cone portion 2*a* has a truncated cone shaped circumference and opens at the bottom towards a back surface 1*b*, which is the opposite side to the ejection face 1*a* of the substrate 1. The column portion 2*b* has a diameter d of substantially 20 to 30 μm. The top of the truncated cone portion 2*a* has the same diameter as that of the column portion 2*b* and is connected to the column portion 2*b*. The opening formed by the column portion 2*b* towards the ejection face 1*a* serves as an ejection opening 2*c* where ink is ejected. The ejection opening 2*c* has the smallest diameter within the nozzle hole 2.

A nickel coat 16 as an interface layer is annularly formed on the back surface 1*b* outside the opening of the truncated-cone portion 2*a*. Further, a water-repellent coat 13 is formed on the nickel coat 16. In a plan view, the nickel coat 16 and the water-repellent coat 13 enclose therein the opening of the truncated-cone portion 2*a* on the back surface 1*b*. A width y of the nickel coat 16 and the water-repellent coat 13 (which means a difference between a radius of their outer circle and a radius of their inner circle) is substantially 40 μm. A distance of the nickel coat 16 and the water-repellent coat 13 from the opening of the truncated-cone portion 2*a* (which means a difference between a radius of the truncated-cone portion 2*a* and a radius of the inner circle of the nickel coat 16 and the water-repellent coat 13) is substantially 10 μm. The ejection face 1*a* is covered with a nickel coat 6 as an interface layer, and further a water-repellent coat 3 is formed on the nickel coat 6.

The water-repellent coats 3, 13 are made by nickel plating containing a fluorine-based macromolecular material such as polytetrafluoroethylene (PTFE) or the like, and have a thickness of substantially 1.5 μm. The nickel coat 6, 16 do not contain a fluorine-based macromolecular material, and have a thickness of substantially 0.1 μm.

The nickel coat 6 and the water-repellent coat 3 respectively have through holes 6*a* and 3*a* which share the central axis O with the nozzle hole 2, and communicate with the nozzle hole 2. The ejection opening 2*c* of the nozzle hole 2, or an inner wall of the column portion 2*b* are not obstructed by the nickel coat 6 or the water-repellent coat 3. To the contrary, areas of the ejection face 1*a* other than the ejection opening 2*c* are covered with the nickel coat 6 and the water-repellent coat 3.

The through hole 3*a* of the water-repellent coat 3 includes a straight portion 3*c* and a diameter expansion portion 3*b*. The straight portion 3*c* is contiguous to the nozzle hole 2 and has the same diameter d as the ejection opening 2*c*. The diameter expansion portion 3*b* is provided to interpose the straight portion 3*c* with the nozzle hole 2, and gradually expands so that a part thereof farther from the straight portion 3*c* has a larger diameter than a part thereof closer to the straight portion 3*c*. The diameter expansion portion 3*b* has a circumference curved so as to protrude towards the central axis O of the through hole 3*a*, where the axial direction length x along the central axis O is 0.1 μm or more but 0.5 μm or less. The water-repellent coat 3 has a lower surface 3*x* where the straight portion 3*c* is open and an upper surface 3*y* where the diameter expansion portion 3*b* is open. The lower surface 3*x* extends parallel to the ejection face 1*a*. The upper surface 3*y* extends parallel to the lower surface 3*x* and is distant from the lower surface 3*x* along the axis O. The through hole 6*a* of the nickel coat 6 has the same diameter d as the ejection opening 2*c*, that is, the same diameter d as the straight portion 3*c*. Thus, a cylindrical airspace having the diameter d is formed from the column portion 2*b* to the straight portion 3*c*.

Next, a method of manufacturing the nozzle plate P will be described with reference to FIG. 2.

First, by carrying out a pressing to form the truncated-cone portion 2*a* and the column portion 2*b*, the nozzle hole 2 is formed in the substrate 1. If the pressing generates a protrusion such as a burr on the ejection face 1*a*, grinding and polishing is carried out after the pressing, to eliminate the protrusion. Here, the nozzle hole 2 may be formed by etching.

Figure 2:
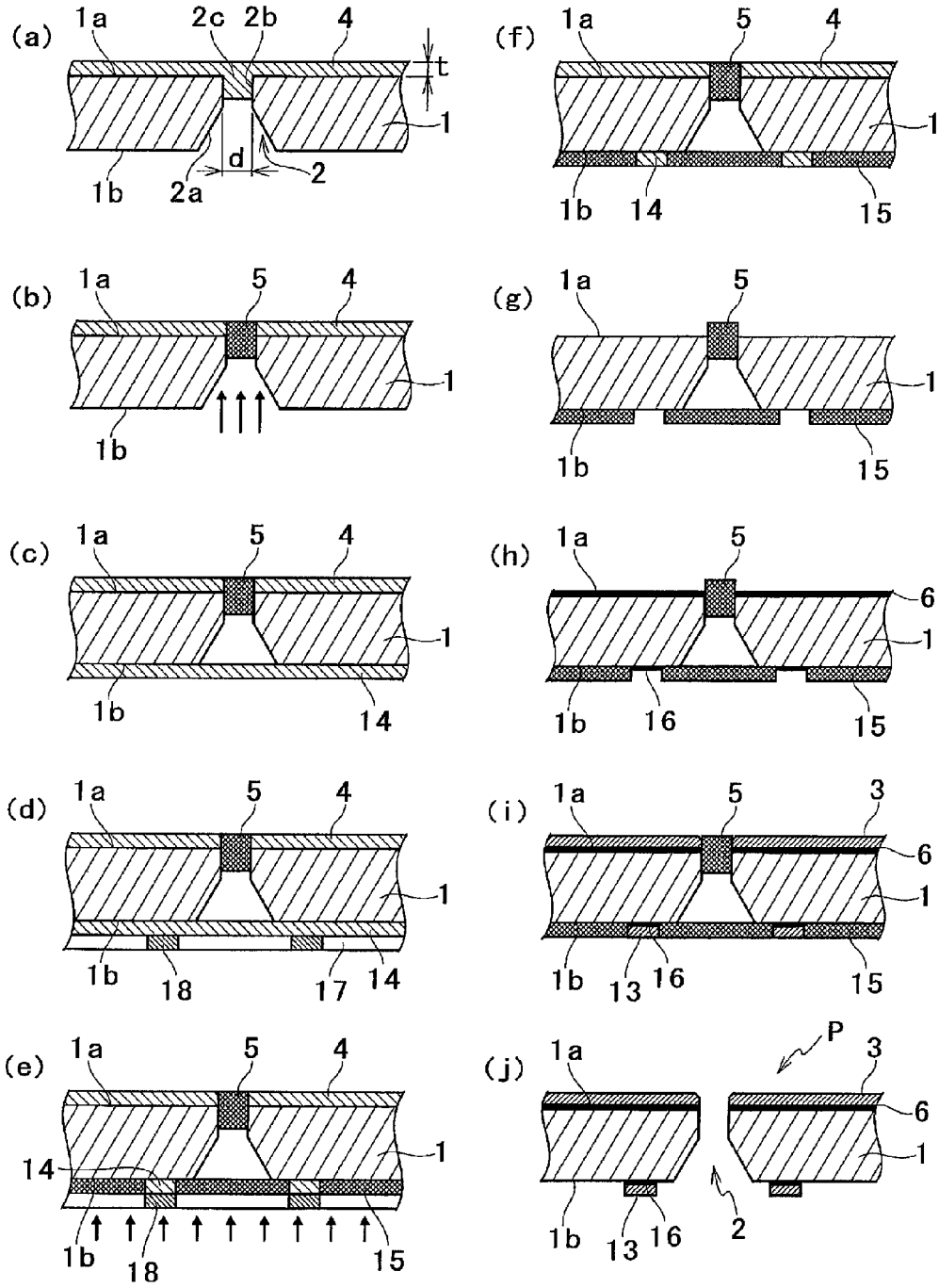
FIG. 2 is an explanatory view showing a method of manufacturing the nozzle plate.

Thereafter, as shown in FIG. 2(*a*), a film of a light-curable resin 4 serving as a resist is heated and at the same time press-bonded to the ejection face 1*a* of the substrate 1 with a use of a roller or the like. By adjusting a heating temperature, pressure, a speed of the roller, or the like, the ejection face 1*a* is covered with the light-curable resin 4, and a predetermined amount of the light-curable resin 4 is supplied to a leading end area of the column portion 2*b* of the nozzle hole 2. Note that if the heating temperature is too high, such as a case where the temperature is far beyond a glass transition point, the light-curable resin 4 begins to show liquidity, and the ejection face 1*a* therefore cannot be coated with the light-curable resin 4 of necessary film thickness (for example, substantially 15 μm). To the contrary, if the heating temperature is too low, the film does not soften so that the necessary amount of light-curable resin 4 cannot be supplied to the leading end area of the column portion 2*b*.

In view of that, the heating temperature is set, for example, at the glass transition point where the light-curable resin 4 begins to show a soft rubber-like characteristic. Note that, the heating temperature is preferably set within the range of 80 to 100 degrees C.; however, the temperature is not limited to this range. Moreover, to make it easy to supply a necessary amount of the light-curable resin 4 to the leading end area of the column portion 2*b*, the thickness t of the light-curable resin 4 is preferably equal to or smaller than the diameter d of the column portion 2*b*.

Then, as shown in FIG. 2(*b*), ultraviolet (UV) light irradiated in a direction from the back-surface 1*b* towards the ejection face 1*a* of the substrate 1 is applied to the substrate 1, thereby partially cure the light-curable resin 4. A part of the light-curable resin 4 inside the nozzle hole 2 and another part of the light-curable resin 4 outside the nozzle hole 2 which overlaps the ejection opening 2*c* in the direction from the back surface 1*b* to the ejection face 1*a* are cured by the light passing through the nozzle hole 2. Hence, a cured resin 5 having a cylindrical shape is formed. The substrate 1 where the nozzle hole 2 is formed functions as a mask during irradiation of the ultraviolet light. Thus, a diameter of the cured resin 5 is substantially the same as that of the ejection opening 2*c* at any point along the axial direction. Here, a light exposure is adjusted in order to prevent the light-curable resin 4 existing near the ejection opening 2*c* from being cured in a state where it is extending outward in a radial direction of the nozzle hole 2.

Thereafter, as shown in FIG. 2(*c*), a film of a light-curable resin 14, which is similar to the light-curable resin 4 applied on the ejection face 1*a*, is heated and at the same time press-bonded to the back surface 1*b* with a use of a roller or the like.

By adjusting a heating temperature, pressure, a speed of the roller, or the like, the back surface 1*b* is covered with the light-curable resin 14.

Further, as shown in FIG. 2(*d*), the light-curable resin 14 is covered with a transparent film 17. The transparent film 17 has an annular light-shielding region 18 which is formed so as to enclose therein the opening of the truncated-cone portion 2*a* opened on the back surface 1*b*. That is, an inner circle and an outer circle of the light-shielding region 18 have diameters larger than that of the opening of the truncated-cone portion 2*a* on the back surface 1*b*.

Then, as shown in FIG. 2(*e*), ultraviolet (UV) light irradiated in a direction from the back-surface 1*b* towards the ejection face 1*a* of the substrate 1 is applied to the substrate 1 with interposition of the transparent film 17, thereby partially cure the light-curable resin 14. At this time, a portion of the light-curable resin 14 not overlapping the light-shielding region 18 is cured, thus forming a cured resin 15.

Then, as shown in FIG. 2(*f*), the transparent film 17 is removed to expose the cured resin 15 and the uncured light-curable resin 14.

Thereafter, uncured portions of the light-curable resins 4, 14 on the ejection face 1*a* and the back surface 1*b*, that is, portions other than the cured resins 5, 15, are eliminated with a developer such as an alkaline developer containing 1%-Na2CO3 (first and second eliminating steps). Then, by performing a post-bake at a predetermined temperature for a predetermined period of time, moisture within the cured resins 5, 15 is removed to increase adhesion between the cured regions 5, 15 and the substrate 1. Thereby, as shown in FIG. 2(*g*), the cured resins 5, 15 are left protruding from the ejection face 1*a* and the back surface 1*b*, respectively. Protruding extents of the cured resins 5 and 15 respectively from the ejection face 1*a* and the back surface 1*b* are greater than a total thickness of the nickel coat 6 and the water-repellent coat 3 which will be formed later and a total thickness of the nickel coat 16 and the water-repellent coat 13 which will be formed later, respectively. In this embodiments, the protruding extends are substantially 15 μm.

Then, in order to enhance bonding strength of the nickel coats 6, 16 to the substrate 1, the substrate 1 is soaked in 10%-nitric acid at a room temperature for 30 seconds, and a surface of the substrate 1 is polished. Then, electroplating is carried out with the cured resins 5, left unremoved, so as to form nickel coats 6, 16 having a thickness of substantially 0.1 μm on the ejection face 1*a* and the back surface 1*b*, respectively. At this time, the cured resins 5, 15 function as masks against plating coats. In this step, as shown in FIG. 2(*h*), the nickel coats 6, 16 are not formed on the cured resins 5, 15 which are nonmetal, but selectively grow on the conductive substrate 1. At this time, the cured resins 5, 15 are left protruded from an upper surface of the nickel coats 6, 16.

Afterwards, as shown in FIG. 2(*i*), water-repellent coats 3, 13 are formed respectively on the nickel coats 6, 16 formed on the ejection face 1*a* and the back surface 1*b* by electroplating, using the cured resins 5, 15 as masks. In this step, the current density of the electroplating is adjusted so that, where a position which is a distance x (see FIG. 1) away from the upper surface 3*y* of the water-repellent coat 3 is a reference position, the inner circumference of the water-repellent coat 3 below the reference position contacts the cured resin 5, while the inner circumference above the reference position does not contact the cured resin 5 but gradually distances from the cured resin 5 in such a manner that a part of the inner circumference farther from ejection face 1*a* is farther distanced from the cured resin 5 than a part of the inner circumference closer to the ejection face 1*a*. In other words, the current density is adjusted so as to form in the water-repellent coat 3, the through-hole 3*a* having the straight portion 3*c* and the diameter expansion portion 3*b*. More specifically, the current density of the electroplating is 0.5 A/dm$^2$ or higher but 2 A/dm$^2$ or lower.

The current density of 0.5 A/dm$^2$ produces a water-repellent coat 3 with the diameter expansion portion 3*b* having an axial direction length x of substantially 0.5 μm. The current density of 2 A/dm$^2$ produces a water-repellent coat 3 with the diameter expansion portion 3*b* having an axial direction length x of substantially 0.1 μm. The plating time to form a water-repellent coat 3 is substantially 20 minutes when the current density is 0.5 A/dm$^2$, and is substantially 5 minutes when the current density is 2 A/dm$^2$. In either case, a water-repellent coat 3 having a total thickness of substantially 1.5 μm is formed. Note that the temperature of the plating solution is substantially 50 degrees C.

After the formation of the water-repellent coats 3, 13 through the above method, a release agent which is 3%-NaOH or the like is used to melt the cured resins 5, 15 and eliminate it from the substrate 1. Thus, as shown in FIG. 2(*j*), there is completed a nozzle plate P where, in the ejection face 1*a*, the ejection opening 2*c* of the nozzle hole 2 is open via the through hole 6*a* of the nickel coat 6 and the through hole 3*a* of the water-repellent coat 3 while, in the back surface 1*b*, the bottom of the truncated-cone portion 2*a* is open within an annulus of the nickel coat 16 and the water-repellent coat 13. The back surface 1*b* is exposed in a region of substantially 10 μm which exists between the opening of the truncated-cone portion 2*a* on the back surface 1*b* and the inner circle of the nickel coat 16 and the water-repellent coat 13.

As mentioned above, according to the method of the present embodiment for manufacturing a nozzle plate P, an annular protrusion, that is, the water-repellent coat 3, is formed on the back surface 1*b* of the nozzle plate P to which another plate will be bonded, in such a manner that the annular protrusion encloses the opening of the truncated-cone portion 2*a* of the nozzle hole 2. The water-repellent coat 3 can effectively prevent an adhesive from entering the nozzle hole at the time when another plate is being bonded to the nozzle plate P. In addition, since the water-repellent coat 13 on the back surface 1*b* is formed simultaneously with the water-repellent coat 3 on the ejection face 1*a*, a manufacturing process can be simplified.

Since the openings of the nozzle hole 2 on the ejection face 1*a* and the back surface 1*b* are sealed with the cured resins 5, 15, a developer used in the first and second eliminating steps and the plating solution used in the water-repellent coat forming step do not enter the nozzle hole 2.

The first eliminating step for eliminating the uncured portion of the light-curable resin 4 is performed simultaneously with the second eliminating step for eliminating the uncured portion of the light-curable resin 14. This can further simplify the manufacturing process.

The substrate 1 is made of stainless steel, and there is the nickel coat forming step after the first and second eliminating steps but before the water-repellent coat forming step. In the nickel coat forming step, the nickel coats 6, 16 having a thickness smaller than that of the water-repellent coat 3 are formed respectively on the ejection face 1*a* and the back surface 1*b*, with use of the cured resins 5, 15 as masks. In the water-repellent coat forming step, the water-repellent coats 3, 13 having a thickness larger than that of the nickel coats 6, 16 are formed respectively on the nickel coats 6, 16. As a result, the nickel coats 6, 16 exist between the substrate 1 and the water-repellent coats 3, 13. This can improve adhesion of the water-repellent coats 3, 13 to the substrate 1. In addition, since the nickel coats 6, 16 are thin, they can be produced in a short time.

The nickel coats 6, 16 may be formed by non-electro plating; however, in this case, it is necessary to prepare a production equipment for nickel coat 6, 16 formation, aside from the production equipment for water-repellent coats 3, 13 formation. When the nickel coats 6, 16 are formed by the same electroplating for forming the water-repellent coats 3, 13 as in the present embodiment, it is possible to simplify the production equipments and avoid complication of steps since the production equipments other than the plating solutions can be shared.

In the water-repellent coat forming step, the water-repellent coats 3, 13 are formed by electroplating with the relatively low current density of 0.5 A/dm$^2$ or higher but 2 A/dm$^2$ or lower. As a result, the water-repellent coat 13 having a smaller plating area and the water-repellent coat 3 having a relatively larger plating area do not easily differ in thickness.

As described below, if the current density of the electroplating in the water-repellent coat forming step is 2 A/dm$^2$ or higher, the axial direction length x of the diameter expansion portion 3*b* decreases. This increases the possibility of the adhesion of foreign matters to the part corresponding to the straight portion 3*c* of the water-repellent coat 3 during wiping. Consequently, the interference of ink ejection due to the adhesion of foreign matters becomes conspicuous.

As described below, if the axial direction length x of the diameter expansion portion 3*b* is less than 0.1 μm, the boundary of the upper surface 3*y* and the diameter expansion portion 3*b* becomes too close to the ejection opening 2*c* in a plan view. If the axial direction length x of the diameter expansion portion 3*b* is 0.1 μm, for example, the above boundary is placed substantially 1 μm distant from the circumference of the ejection opening 2*c* in a plan view. If the axial direction length x of the diameter expansion portion 3*b* is 0.5 μm, the boundary is placed substantially 7 to 8 μm distant from the circumference of the ejection opening 2*c* in a plan view. Therefore, taking the sizes and the shapes of foreign matters in consideration, if the axial direction length x of the diameter expansion portion 3*b* is less than 0.1 μm, there will be a higher possibility of foreign matters adhering to the part corresponding to the straight portion 3*c* of the water-repellent coat 3 during wiping, and the ink ejection is more conspicuously disturbed by the adherence of foreign matters. Moreover, if the axial direction length x exceeds 0.5 μm, it is necessary to decrease the current density of the electroplating in the water-repellent coat forming step. Thus, it takes longer to form a water-repellent coat. Decreasing the current density is effective in terms of less difference between the thickness of the water-repellent coat 13 having a smaller plating area and the thickness of the water-repellent coat 3 having a relatively larger plating area. However, if it takes longer to form a water-repellent coat, the cured resins 5, 15 immersed into a plating solution may swell. In particular, the cured resin 5 defines a diameter of the straight portion 3*c* of the water-repellent coat 3. Accordingly, the swelling of the cured resin 5 may cause unevenness in the diameter of the straight portion 3*c*.

In view of that, the current density of electroplating in the water-repellent coat forming step is set to 0.5 A/dm$^2$ or higher but 2 A/dm$^2$ or lower, as in this embodiment. That way, it is possible to prevent the ink ejection from being disturbed by the adherence of foreign matters, and to shorten the manufacturing time.

Next, the following describes an experiment conducted on the current density of the electroplating in the water-repellent coat forming step. In the experiment used was a substrate 1 of 70 μm in thickness which is made of SUS 430 and has a nozzle hole 2 having a column portion 2*b* whose diameter d is 20 μm. Thereafter, the light-curable resin 4 was press-bonded, while heating the same, to an ejection face 1*a* of the substrate 1. Then, the ejection face 1*a* was covered with the light-curable resin 4 of substantially 15 μm in thickness, and a predetermined amount of the light-curable resin 4 was supplied to the leading end area of the column portion 2*b* of the nozzle hole 2. Afterwards, the cured resin 5 was formed by partially curing the light-curable resin 4 by applying ultraviolet light. After eliminating the uncured portion of the light-curable resin 4, the nickel coat 6 having a thickness of 0.1 μm was formed on the ejection face 1*a* by electroplating. Then, the current density of the electroplating in the water-repellent coat forming step was changed. Then, the resulting axial direction length x of the diameter expansion portion 3*b* in the water-repellent coat 3, and the resulting foreign matter deposit ratio, i.e., a hole-edge foreign matter deposit ratio, to the part corresponding to the straight portion 3*c* during wiping, were examined. The thickness of the water-repellent coat 3 was set to 1.5 μm.

Note that the hole-edge foreign matter deposit ratio is a ratio of the number of nozzle holes 2 where foreign matters adhered to the part corresponding to the straight portion 3*c* by wiping, to the total number of nozzle holes 2. Hereinafter, the hole-edge foreign matter deposit ratio is called simply as the "ratio".

Figure 3:
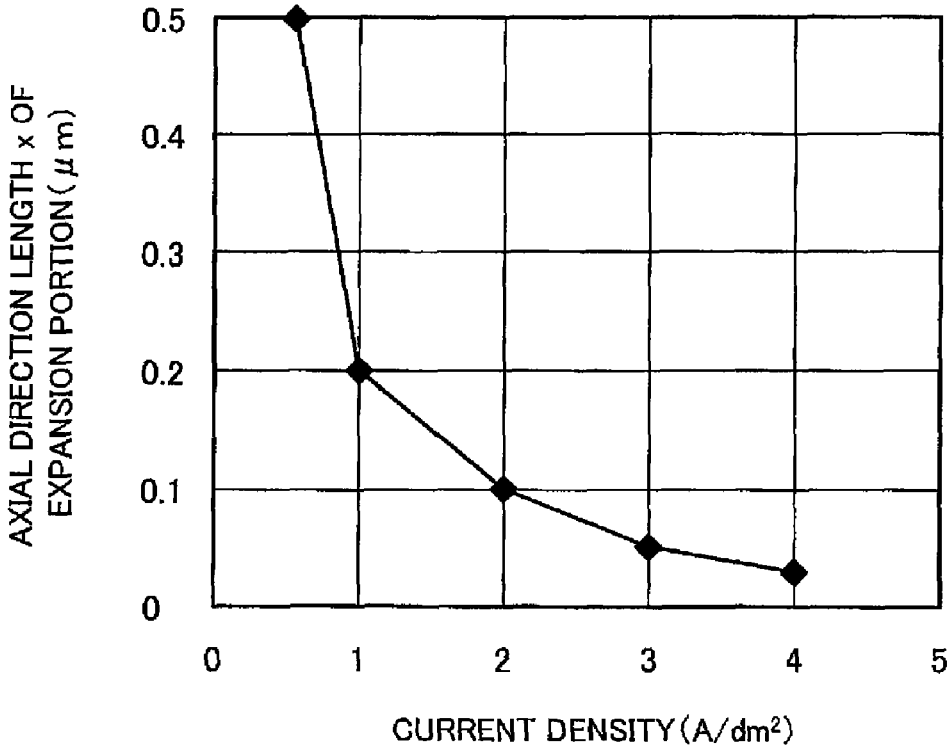
FIG. 3 is a graph showing a relation between a current density of electroplating and an axial direction length of an diameter expansion portion in a water-repellent coat forming step.
Figure 4:
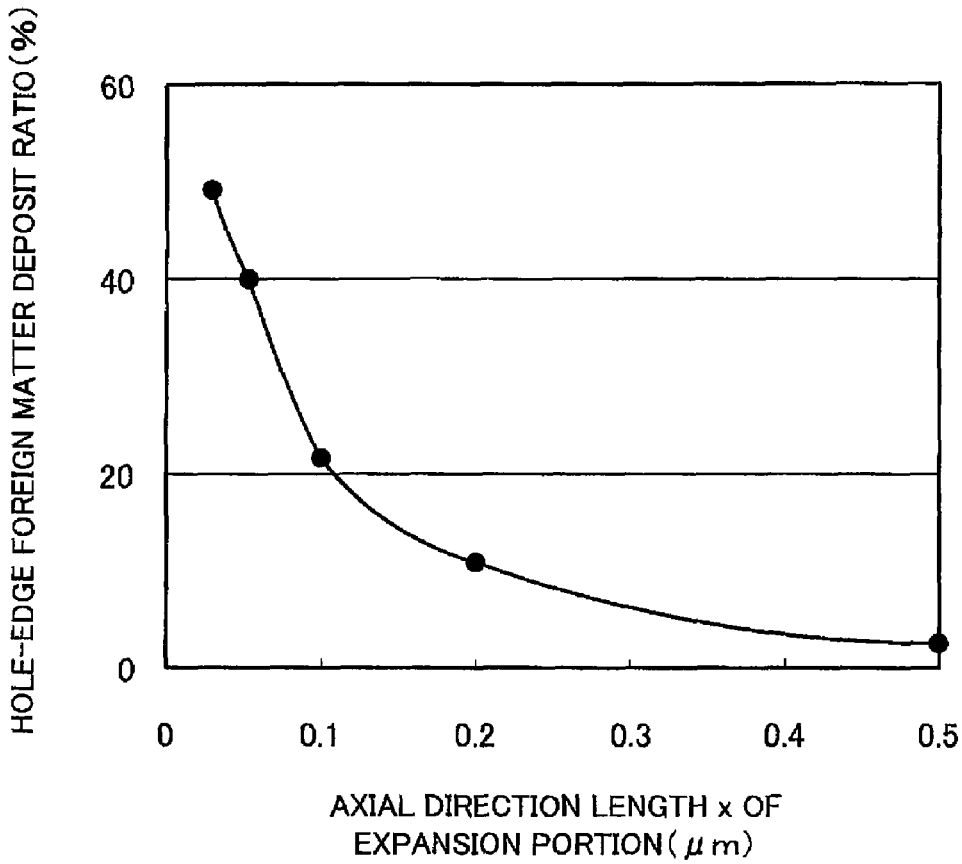
FIG. 4 is a graph showing a relation between the axial direction length of the diameter expansion portion and a hole-edge foreign matter deposit ratio.

FIG. 3 is a graph showing the relation of the current density of the electroplating and the axial direction length x of the diameter expansion portion 3*b* in the water-repellent coat forming step. FIG. 4 is a graph showing the relation of the axial direction length x of the diameter expansion portion 3*b* and the ratio.

As shown in FIG. 3, when the current density is 0.5 A/dm$^2$, the axial direction length x of the diameter expansion portion 3*b* is 0.5 μm, and the ratio is substantially 3% as seen in FIG. 4. The axial direction length x of the diameter expansion portion 3*b* decreases with an increase in the current density, and is substantially 0.03 μm when the current density is 4 A/dm$^2$. If the current density exceeds 4 A/dm$^2$, the axial direction length x of the diameter expansion portion 3*b* is predicted to be asymptotic to 0 μm. Moreover, as shown in FIG. 4, the ratio increases when the axial direction length x of the diameter expansion portion 3*b* decreases. Once the axial direction length x of the diameter expansion portion 3*b* falls below 0.1 μm, the ratio rapidly increases with a decrease in the length. When the axial direction length x of the diameter expansion portion 3*b* is substantially 0.03 μm, i.e., when the current density is 4 A/dm$^2$, the ratio is 50%. If the axial direction length x of the diameter expansion portion 3*b* falls below 0.03 μm, i.e., if the current density exceeds 4 A/dm$^2$, the ratio is predicted to be asymptotic to a high-rate exceeding 50%. Thus, it is found that, with an increase in the current density, the axial direction length x of the diameter expansion portion 3*b* decreases and the hole-edge foreign matter deposit rate increases.

It is understood by FIG. 4 that the longer the axial direction length x of the diameter expansion portion 3*b*, the more difficult it becomes for foreign matters to adhere to the part corresponding to the straight portion 3*c* during wiping. Moreover, it is understood that when the axial direction length x of the diameter expansion portion 3*b* approaches 0, that is when the diameter expansion portion 3*b* barely exists and the through hole 3*a* is formed only with the straight portion 3*c*, foreign matters adhere more easily to the section corresponding to the straight portion 3*c* during wiping. In short, it is understood that the diameter expansion portion 3*b* contributes to the prevention of adhesion of foreign matters to the part corresponding to the straight portion 3*c*.

If foreign matters adhere to the part corresponding to the straight portion 3*c*, the ink ejection from the nozzle hole 2 is disturbed by foreign matters, causing variation in the direction of ink ejection, thus deteriorating the printing quality. In view of that, it is important to form the diameter expansion portion 3*b* so as to highly contribute to the prevention of foreign matter adhesion. Moreover, the diameter expansion portion 3*b* preferably maintains a high contribution to the prevention of foreign matter adhesion, even when the manufacturing condition changes more or less. As seen in FIG. 4, the ratio rapidly increases with a decrease in the axial direction length x of the diameter expansion portion 3*b*, once the length falls below 0.1 μm. When the axial direction length x of the diameter expansion portion 3*b* is 0.1 μm or more, the change in the ratio to the change in the axial direction length x of the diameter expansion portion 3*b* becomes smaller, and the ratio becomes lower than substantially 20% constantly. According to FIG. 3, in order to form the water-repellent coat 3 with the axial direction length x of the diameter expansion portion 3*b* of 0.1 μm or more, current density should be set as 2 A/dm$^2$ or lower. On the other hand, it is necessary to consider manufacturing time and evenness in the diameter of the straight portion 3*c*. Therefore, the current density is preferably set to at least the value where the water-repellent coat 3 having the axial direction length x of the diameter expansion portion 3*b* of 0.5 μm is formed, i.e., the value of 0.5 A/dm$^2$.

Accordingly, in the water-repellent coat formation step, the current density of the electroplating is preferably set at 0.5 A/dm$^2$ or higher but 2 A/dm$^2$ or lower so that the axial direction length x of the diameter expansion portion 3 is 0.1 μm or more but 0.5 μm or less.

In the experiment, the axial direction length x of the diameter expansion portion 3*b* and the broadening of the diameter expansion portion 3*b* from the straight portion 3*c* were both measured with a non-contact surface roughness measure (More specifically, a non-contact three-dimensional surface formation/roughness measure made by Zygo: New View 5032).

It may not always be necessary that the first eliminating step and the second eliminating step are performed simultaneously. They may be performed separately.

It may not always be necessary that the substrate 1 of the nozzle plate P is formed of a conductive member such as stainless steel. The substrate 1 may be formed of other materials as long as they have non-translucency.

The present invention is not limited to a structure in which nickel coats 6, 16 are formed between the ejection face 1*a* and the water-repellent coat 3, and between the back surface 1*b* and the water-repellent coat 13, respectively. For example, instead of the nickel coats 6, 16, the ejection face 1*a* and the water-repellent coat 3, and the back surface 1*b* and the water-repellent coat 13 may interpose a chrome plating coat, a copper plating coat, a lamination of several plating films, or the like. Alternatively, the water-repellent coats 3, 13 may be directly formed on the ejection face 1*a* and the back surface 1*b* with no layer interposed therebetween.

The formation of the water-repellent coats 3, 13 and the nickel coats 6, 16 is not limited to electroplating, and other methods such as non-electroplating or the like are possible.

The light applied to the substrate 1 in the curing step advances in a direction from the back-surface 1*b* of the substrate 1 towards the ejection face 1*a*; however, it can advance in a direction other than the above direction, as long as the light includes a component directed in the above direction.

The current density of the electroplating in the water-repellent coat forming step is preferably 0.5 A/dm$^2$ or higher but 2 A/dm$^2$ or lower; however, the range of the current density is not limited to this. For example, in order to reduce the ratio as much as possible, the current density may be set to 0.5 A/dm$^2$ or lower, though the effect that the manufacturing time can be shortened is sacrificed therefor. In this case, however, a caution is required to avoid unevenness in the diameter of the straight portion 3*c*. This limits the amount of manufacturing time extendable.

In the curing step, the curable resin 5 does not have to be completely cured, and may be half-cured. Doing so will leave adhesiveness in curable resin 5, since cure reaction is not completed. With this adhesiveness, it is less likely that the curable resin 5 falls due to vibration and shock in the later steps.

The width y of the nickel coat 16 and the water-repellent coat 13 can be arbitrarily changed such as to substantially 20 to 80 μm, as long as intrusion of adhesive into the nozzle hole 2 can be prevented. If the width y is too small, a great difference occurs between an area of the water-repellent coat 13 and an area of the water-repellent coat 3 to be formed on the ejection face 1*a*. Therefore, unless the current density is lowered, the water-repellent coat does not easily grow. This tendency may be utilized, to firstly form a water-repellent coat on the ejection face 1*a* with a current density of 4 A/dm$^2$ or higher and then form water-repellent coats on the both faces 1*a* and 1*b* with a current density of 0.5 A/dm$^2$ or higher but 2 A/dm$^2$ or lower, for example. In such a case, at an initial stage, a large part of a thickness of the water-repellent coat 3 can be formed on the ejection face 1*a* in a relatively short time. Therefore, it takes a shorter time to from the water-repellent coats 3, 13. This is effective particularly to make the water-repellent coat 3 larger in thickness. Further, the current density which will be applied later is set to 0.5 A/dm$^2$ or higher but 2 A/dm$^2$ or lower. That way, for the same reason as described above, it is possible to prevent the ink ejection from being disturbed by the adherence of foreign matters, and to shorten the manufacturing time.

The method of manufacturing a nozzle plate according to the present invention is applicable to various equipments other than ink-jet heads.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A method of manufacturing a nozzle plate having a nozzle hole which ejects liquid, comprising the steps of;

(a) forming the nozzle hole penetrating through an opaque and conductive plate which becomes the nozzle plate, in a thickness direction of the plate;

(b) covering, with a first light-curable resin, a first surface of the plate which surface has one opening of the nozzle hole to become an ejection opening, and supplying the first light-curable resin into an area inside the nozzle hole contiguous to the one opening;

(c) forming a cured resin portion from the first light-curable resin by applying, to the plate, light directed from a second surface of the plate having an another opening of the nozzle hole to the first surface of the plate so as to cure a part of the first light-curable resin inside the nozzle hole and another part of the light-curable resin outside the nozzle hole, the another part overlapping the one opening in a direction from the second surface to the first surface;

(d) eliminating an uncured portion of the first light-curable resin after the step of (c);

(e) covering the second surface of the plate with a second light-curable resin after the step of (d);

(f) covering the second light-curable resin with a light-shielding member having an annular light-shielding region which encloses the another opening therein in a plan view;

(g) curing a portion of the second light-curable resin not overlapping the light-shielding region by applying light directed from the second surface to the first surface, to the second light-curable resin with interposition of the light-shielding member, after the step of (f);

(h) exposing the second light-curable resin by removing the light-shielding member after the step of (g);

(i) eliminating an uncured portion of the second light-curable resin after the step of (h);

(j) forming a water-repellent coat respectively on the first and second surfaces using the cured first and second light-curable resins as masks, by electroplating with a current density of greater than or equal to 0.5 $A/dm^2$ but less than or equal to 2 $A/dm^2$, after the steps of (d) and (i); and (k) eliminating the cured first and second light-curable resins after the step of (j).

2. The method according to claim 1, wherein the step of (d) is performed simultaneously with the step of (i).

3. A method of manufacturing a nozzle plate having a nozzle hole which ejects liquid, comprising the steps of;

(a) forming the nozzle hole penetrating through an opaque plate which becomes the nozzle plate, in a thickness direction of the plate;

(b) covering, with a first light-curable resin, a first surface of the plate which surface has one opening of the nozzle hole to become an ejection opening, and supplying the first light-curable resin into an area inside the nozzle hole contiguous to the one opening;

(c) forming a cured resin portion from the first light-curable resin by applying, to the plate, light directed from a second surface of the plate having an another opening of the nozzle hole to the first surface of the plate so as to cure a part of the first light-curable resin inside the nozzle hole and another part of the light-curable resin outside the nozzle hole, the another part overlapping the one opening in a direction from the second surface to the first surface;

(d) eliminating an uncured portion of the first light-curable resin after the step of (c);

(e) covering the second surface of the plate with a second light-curable resin after the step of (d);

(f) covering the second light-curable resin with a light-shielding member having an annular light-shielding region which encloses the another opening therein in a plan view;

(g) curing a portion of the second light-curable resin not overlapping the light-shielding region by applying light directed from the second surface to the first surface, to the second light-curable resin with interposition of the light-shielding member, after the step of (f);

(h) exposing the second light-curable resin by removing the light-shielding member after the step of (g);

(i) eliminating an uncured portion of the second light-curable resin after the step of (h);

(j) electroplating a water-repellent coat respectively on the first and second surfaces using the cured first and second light-curable resins as masks, after the steps of (d) and (i); and (k) eliminating the cured first and second light-curable resins after the step of (j), wherein:

the substrate is made of stainless steel;

the method further includes a step of (1) forming a nickel coat thinner than the water-repellent coat respectively on the first and second surfaces using the cured first and second light-curable resins as masks, after the steps of (d) and (i) but before the step of (j); and in the step of (j), the water-repellent coat is formed on the nickel coat.

4. The method according to claim 3, wherein, in the step of (1), the nickel coat is formed by electroplating.

* * * * *